United States Patent [19]

Huertgen et al.

[11] 4,103,529

[45] Aug. 1, 1978

[54] EXTRUSION PRESS FOR DIRECT AND INDIRECT EXTRUDING WITH DIE SHIFTER

[75] Inventors: Helmut B. Huertgen, Pittsburgh; Walter F. Larson, McKeesport; Guenter W. Sibler, Pittsburgh, all of Pa.

[73] Assignee: Sutton Engineering Company, Pittsburgh, Pa.

[21] Appl. No.: 656,518

[22] Filed: Feb. 9, 1976

[51] Int. Cl.[2] ..... B21C 23/08; B21C 35/06

[52] U.S. Cl. ..... 72/253 A; 72/255; 72/263

[58] Field of Search ..... 72/253, 255, 263, 272, 72/273

[56] References Cited

U.S. PATENT DOCUMENTS

| | | | |
|---|---|---|---|
| 2,753,043 | 7/1956 | Poleschuk | 72/255 |
| 3,543,557 | 12/1970 | Lomas | 72/263 |
| 3,563,079 | 2/1971 | Monie et al. | 72/255 |
| 3,827,273 | 8/1974 | Kishino et al. | 72/255 |
| 3,844,151 | 10/1974 | Huertgen | 72/263 |

FOREIGN PATENT DOCUMENTS

| | | | |
|---|---|---|---|
| 369,696 | 2/1923 | Fed. Rep. of Germany | 72/253 |
| 546,590 | 3/1932 | Fed. Rep. of Germany | 72/272 |
| 209,958 | 5/1909 | Fed. Rep. of Germany | 72/263 |
| 1,231,580 | 5/1971 | United Kingdom | 72/263 |
| 271,423 | 10/1927 | United Kingdom | 72/273 |

*Primary Examiner*—C.W. Lanham
*Assistant Examiner*—D. M. Gurley
*Attorney, Agent, or Firm*—Brown, Murray, Flick & Peckham

[57] ABSTRACT

A gate lock housing mounted against the rear face of the front platen of an extrusion press has a passage through it aligned with a passage through the platen. A tubular block is normally disposed in the housing passage where it is held by releasable gate lock means. Behind this block is a laterally movable carrier, in which is seated a bolster member having a passage through it aligned with the block passage. An indirect-extrusion stem secured to the bolster extends rearwardly from the housing and supports an extrusion die at its rear end. The bolster is connected to the block in such a way that the bolster can be moved forward with the block but can move laterally away from the block when they are in their rear position. Shifting means detachably connected with the carrier can slide the bolster and stem laterally away from the block and out beyond one side of the housing, where the carrier can be supported while being disconnected from the shifting means. A second carrier and stem or a carrier supporting a direct-extrusion die then may be connected to the shifting means for return to extruding position.

2 Claims, 7 Drawing Figures

II
II

EXTRUSION PRESS FOR DIRECT AND INDIRECT EXTRUDING WITH DIE SHIFTER

In a direct-extrusion press a billet disposed in a stationary container behind a die is pushed forward out of the container and through the die to form an extrusion. It is sometimes the practice to mount the die in a carrier that can be shifted sideways and then disconnected from the shifting means so that another carrier with another die can be connected to the shifting means and returned to extruding position in front of the container. In an indirect-extrusion press the die is mounted on the rear end of a hollow stem extending rearwardly from a stem holder normally held in place by gate lock means which, when released, permit the stem and die to be pulled forward into the gate lock housing in order to move the extrusion butt into a position where it can be sheared off and also to space the die from a retracted billet container so that a billet can be moved into position between the die and container and then pushed by the die and stem into the container. In an alternate system the stem is secured to a laterally movable die slide. In such a case the shear must be mounted on the moving container holder, but that is an undesirable location for the shear. To extrude the billet after the stem has been projected from a gate lock housing and locked in place, the container and billet are moved forward simultaneously to cause the container to move forward around the stationary stem while the extrusion is being formed. When extruding is completed, the stem and die are moved forward through the container into shearing position and again the container is retracted. With such a press, if it is desired to replace the stem or die or to do any work on them, it is necessary to move them forward out of the press. This requires the use of actuating and supporting members that extend a considerable distance in front of the front platen of the press for withdrawing the stem and supporting it, and such lengthening of the press is undesirable and may not even be possible, due to space restrictions.

It is among the objects of this invention to provide a versatile extrusion press in which a gate lock and die slide are combined so that the press can be used for direct or indirect extrusion, and which can be made shorter than heretofore and will permit an indirect-extrusion stem as well as a direct extrusion die to be shifted laterally in order to move them out to the side of the press for servicing or replacement.

The preferred embodiment of the invention is illustrated in the accompanying drawings, in which FIG. 1 is a fragmentary longitudinal section;

Figures 1, 4:
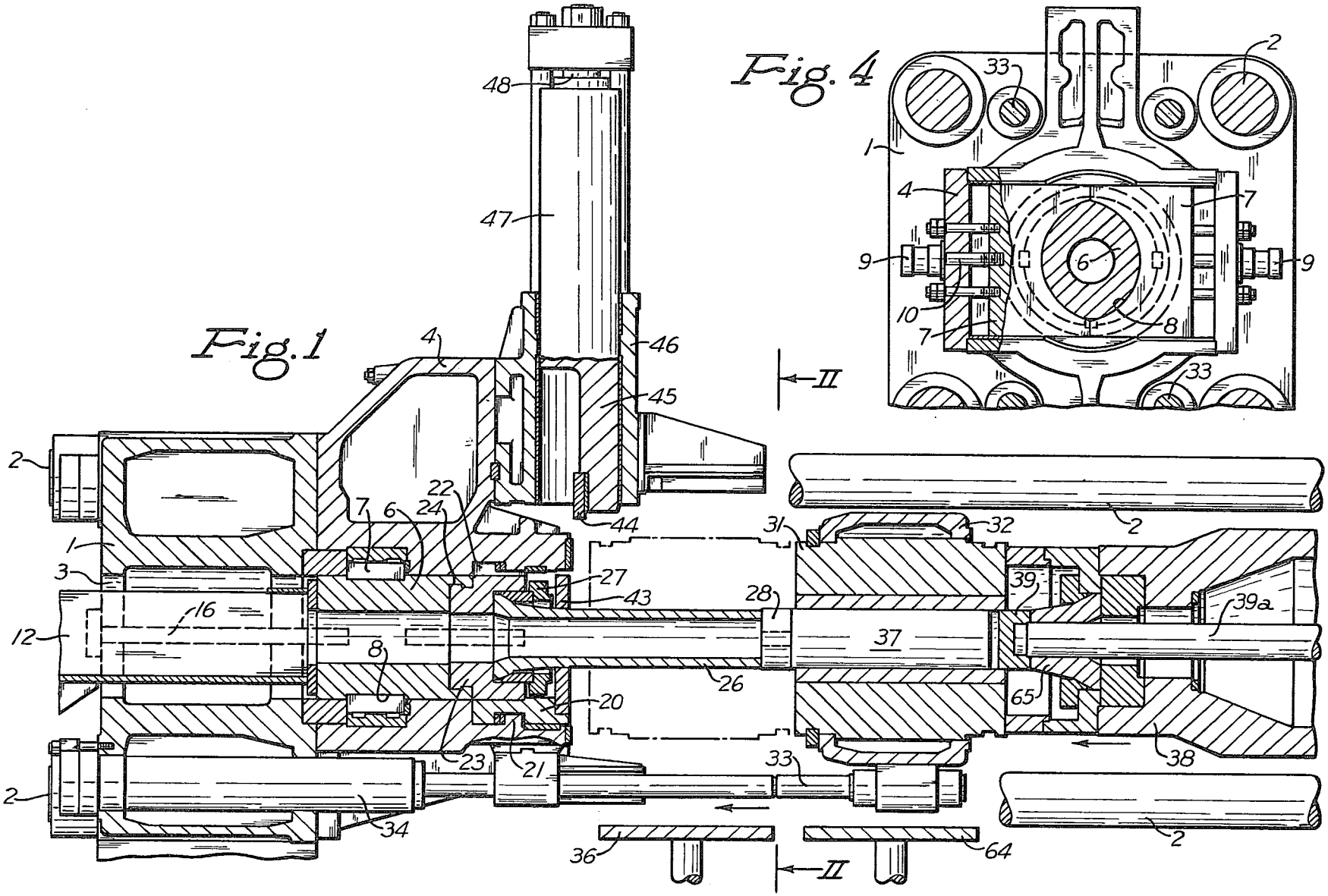
FIG. 4 is a vertical section taken on the line IV—IV of FIG. 3.
Figure 2:
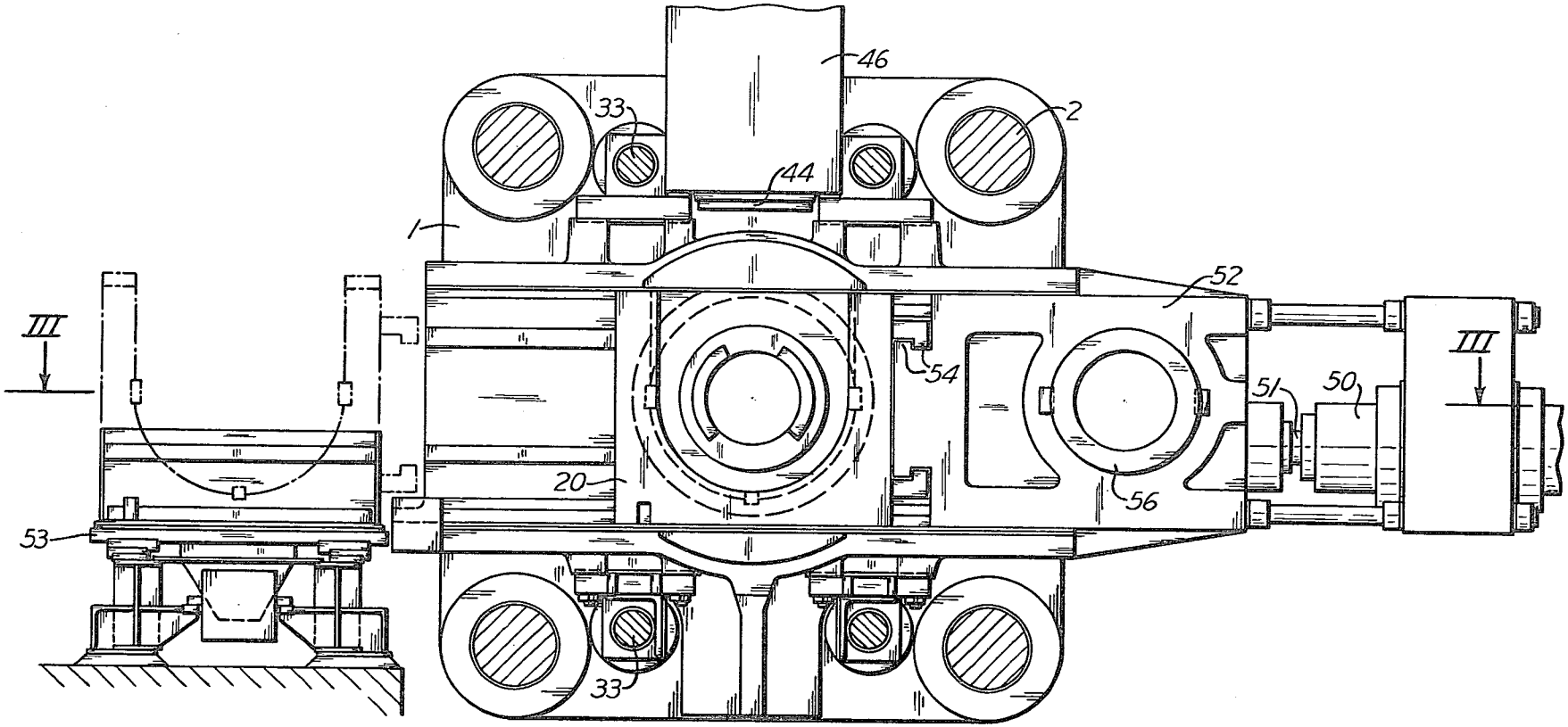
FIG. 2 is a vertical section taken on the line II—II of FIG. 1.
Figure 3:
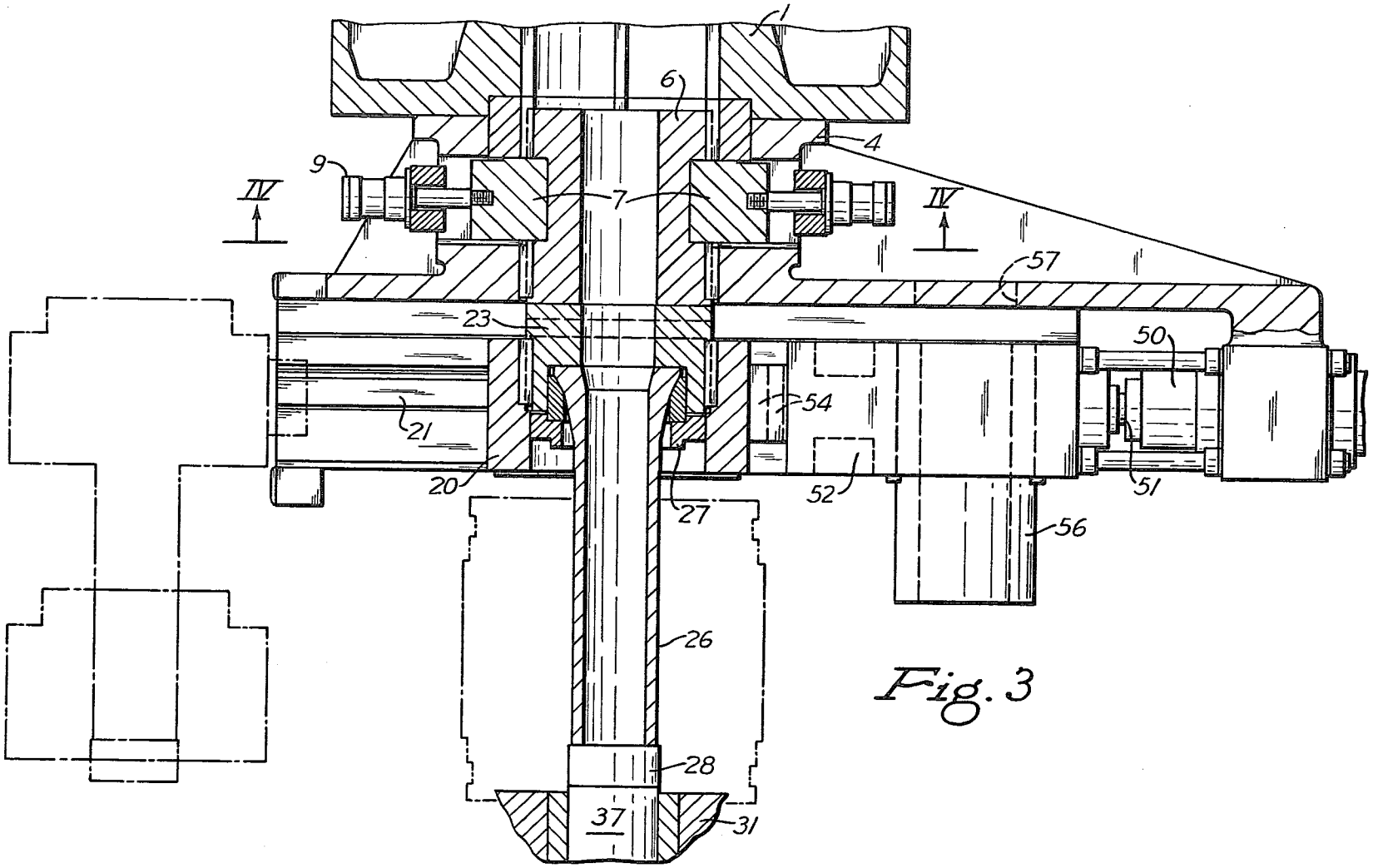
FIG. 3 is an enlarged fragmentary horizontal section taken on the line III—III of FIG. 2.

Referring to the drawings, the extrusion press has heavy front and rear upright platens, only the front platen 1 being shown. The two platens are connected by four heavy tie rods 2 that take the thrust of the extruding operation. As shown in FIG. 3, the platen is provided with a horizontal passage 3 perpendicular to its front and rear faces. Bolted to the back of the platen is a gate lock housing 4 provided with a passage that is aligned with the platen passage. A tubular block member 6 normally is disposed in the housing passage, where it is held by releasable gate lock means as shown in FIGS. 2, 3 and 4. Such means can be formed from a pair of locking members 7 that are slidable horizontally toward and away from each other in guide-ways formed in the housing. The adjacent inner ends of the locking members are provided with recesses that fit part way around the block, which is provided with a peripheral recess 8 for receiving the concave inner ends of the locking members. When they are in locking position, the block cannot be moved axially. The locking members are moved into and out of locking position by fluid pressure cylinders 9 rigidly mounted in the housing and provided with piston rods 10 connected at their outer ends to the locking members. If desired, locking members 7 can be mounted above and below block 6 for vertical operation.

Figures 5, 6, 7:
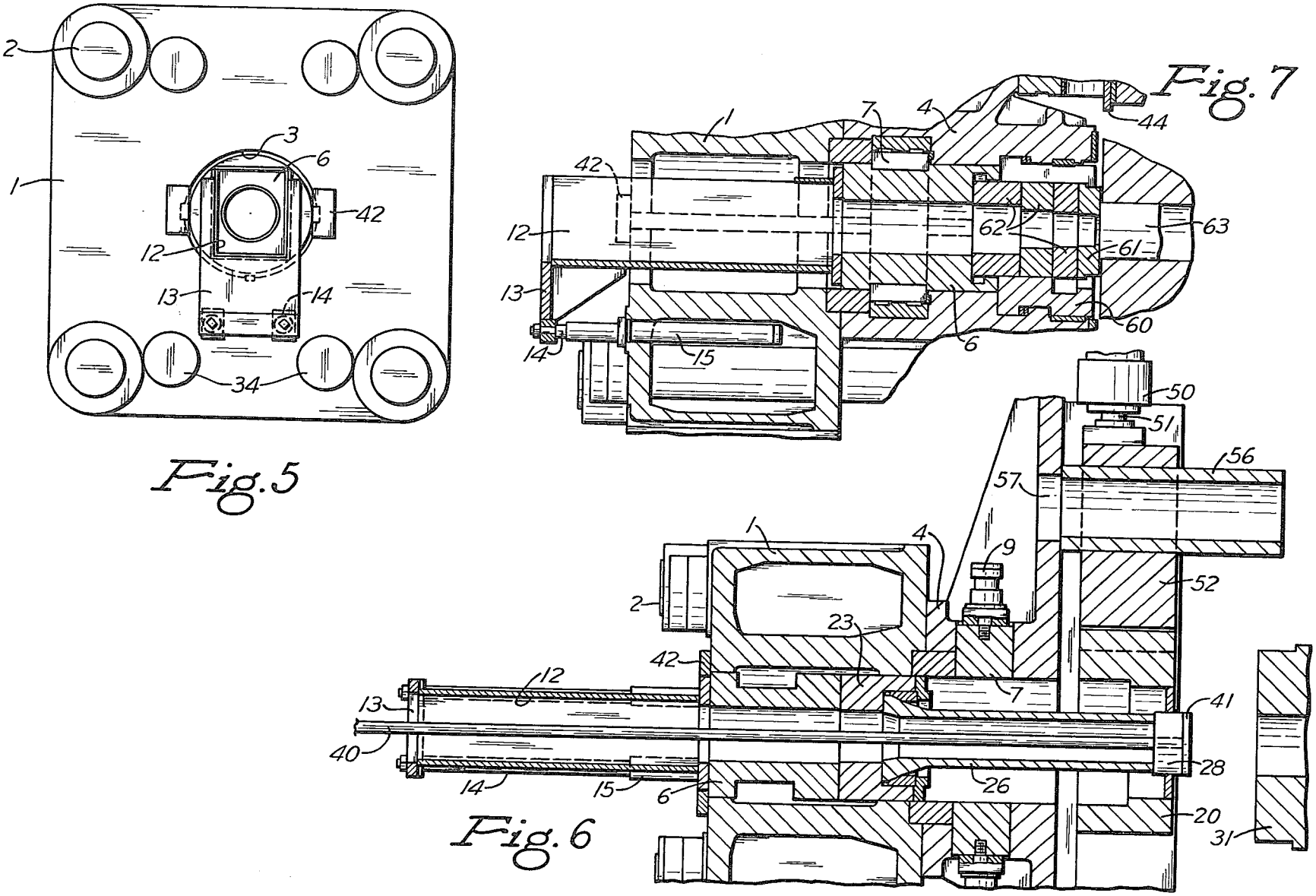
FIG. 5 is a view of the front end of the press.
FIG. 6 is a fragmentary view similar to FIG. 3, but showing the stem moved forward after completing extruding.
FIG. 7 is a fragmentary vertical longitudinal section showing a die in place for direct extrusion.

Secured to the front end of the tubular block 6 is the rear end of a channel 12 that extends forward out of the platen passage. Fastened to the front end of the channel is a vertical plate 13 that extends down below the channel as shown in FIGS. 5 and 7, and is connected to the front ends of a pair of piston rods 14 extending back into fluid pressure cylinders 15 rigidly mounted in the platen. When the gate lock is released, these piston rods can move the block back and forth in the platen passage. The block is guided by horizontal keys 16 mounted in the gate lock housing and platen passages and extending into guide slots in the outside of the block.

Directly behind block 6 there is a carrier 20 that is supported by a horizontal track 21 forming the bottom of an open-end recess extending across the gate lock housing. As shown in FIG. 2, the carrier is U-shape, with portions of its sides extending up into a horizontal slot 22 (FIG. 1) in the top of the housing recess. This slot and the track hold the carrier upright but permit it to be moved back and forth across the gate lock housing. Seated in the carrier is a bolster member 23 that has a passage through it aligned with the passage through the tubular block. The bolster and block are connected in such a way that if the block is moved forward into the platen, it will pull the bolster, as shown in FIG. 6, out of the carrier, but while the block is in its rear position shown in FIGS. 1 and 3, the bolster can be moved laterally away from the block. Accordingly, the block and bolster preferably are connected by interengaging upper and lower horizontal ribs and slots 24. The ribs prevent the two members from being separated axially, but the open end slots allow the bolster to be slid sideways away from the block when they are in their rear position.

Extending rearwardly from the bolster is a hollow indirect-extrusion stem 26 of conventional form. The enlarged front end of the stem is disposed in a recess in the back of the bolster, where it is held by a clamping ring 27 bolted to the bolster. The stem extends a considerable distance out of the gate lock housing and supports at its outer or rear end an extrusion die 28.

For indirect extrusion, a billet container 31 is mounted in a support 32 on the rear ends of four laterally and vertically spaced piston rods 33 that extend forward into fluid pressure cylinders 34 carried by the platen. When the piston rods are extended, they move the billet container back away from the gate lock housing far enough to provide a space between the container and housing for receiving a billet that is to be loaded into the container while the die 28 is in its forward position. This retracted position of the container also is such that it will clear the extrusion die in its rear position for a purpose that will be explained presently.

After the container has been retracted in this manner, a heated billet is raised between it and the gate lock housing by any suitable means 36 to a position where it is in axial alignment with the hollow stem 26, which has been moved forward into the housing to the position shown in FIG. 6. Then, the stem is moved rearwardly by piston rods 14 to push the billet 37 into the container, as shown in FIG. 1. As soon as the stem reaches its rear position, the tubular block 6 is anchored by the gate lock members 7. A ram 38, and a closing disc 39 mounted on the front end of a rod 39*a*, then are moved forward to engage the container and the billet in it. The front ends of cylinders 34 are opened to exhaust so that the ram and closing disc, powered by hydraulic cylinders not shown, can move the container and billet forward in unison. As this occurs, the hot billet is extruded through the die, and the extrusion 40 (FIG. 6) passes through the hollow stem, bolster, block 6 and channel 12 and issues from the front of the press.

At the conclusion of the extruding operation, the container encircles the stem, as indicated in dotted lines in FIG. 1, and there is a thin butt 41 (FIG. 6) at the rear end of the extrusion between the die and the closing disc. The gate lock then is unlocked and the closing disc moved forward by means of rod 39*a* to push the die and stem 26 forward until the billet butt is close to shearing position at the back of the gate lock housing. This passage of the closing disc through the container cleans out the container passage and, of course, occurs during every extrusion cycle. Then the rod, closing disc and the container are retracted and the stem and butt 41 are moved forward the remaining necessary distance by means of piston rods 14 connected with the tubular block. The block is stopped by stops 42 fastened to the front of the platen. The butt is now in shearing position behind and supported by a shear ring 43 that encircles the stem and is bolted to the back of carrier 20. As shown in FIG. 1, above the butt there is a shear blade 44 supported by a slide 45 that is vertically movable in a guide structure 46 secured to the gate lock housing. This slide is mounted on the lower end of a vertical fluid pressure cylinder 47, in which there is a rigid piston 48 that extends out of the top of the cylinder and is rigidly mounted in the top of the guide structure. When fluid under pressure is delivered to the lower end of the cylinder, the shear blade is moved down to shear off the billet butt. After shearing and the placing of a new billet in loading position, the hollow stem and the die are moved back to their projecting position to load the container and the gate lock is locked to hold them there during extruding.

By loading the container from its front end as explained above, as the billet is moved rearwardly into the container by the hollow stem 26, the billet pushes ahead of it any loose metal particles that may be present in the container passage and they will end up in the butt 41 rather than in the extrusion.

It is a feature of this invention that when for any reason it is desired to remove the hollow stem from the bolster 23, or when it becomes necessary to shear off the extrusion in front of the stem, it is unnecessary to pull the stem out of the front of the platen as has been required heretofore. The stem can be removed in accordance with this invention by shifting carrier 20 laterally from its rear position, out to one side of the gate lock housing. This movement of the carrier can be accomplished by different means, including mounting it in a standard die slide, but preferably it is done as shown in FIGS. 2 and 3 by means of a fluid pressure cylinder 50 projecting from one side of the gate lock housing, to which it is secured, and a piston rod 51 projecting from the cylinder and detachably connected to the adjacent side of the carrier, preferably through the medium of a slide 52 attached to the piston rod. When the rod is extended, it pushes the carrier out to one side of the housing and onto a receiving table 53. The carrier then can be disconnected from the slide so that the carrier and bolster and stem can be carried away by a crane for servicing or replacement. Another like carrier, supporting a bolster from which a hollow stem extends, can be connected to the slide and moved back by it to operative position in front of tubular block 6, to which it will become connected by the ribs and slots 24. A similar type of connection exists between the slide and carrier, except that the interengaging ribs 54 extend parallel to the platen passage so that the carrier can be pushed forward on the receiving table to disconnect the carrier from the slide, as indicated in dotted lines in FIG. 2.

Another advantage of being able to move the stem and carrier laterally in this manner is that as the carrier is moved sideways by cylinder 50, the bolster shears off the extrusion, which is not possible with a standard extrusion press of the gate lock type. Such a press requires the hollow stem to be moved out in front of the front platen for such a shearing operation.

A further advantage of the press disclosed herein is that in case it is found that a billet in the container is too cold to extrude and becomes a sticker, the container can be retracted and then the carrier and stem moved laterally to bring into alignment with the billet a heavy sleeve 56 that is rigidly mounted in slide 52 at one side of the carrier. A bar, placed in front of the retracted closing disc 39, then is moved forward by the ram to push the billet out of the container and into the sleeve, which is then moved back to its original position behind an opening 57, through which the sticker can be pushed instead of through the press platen as in the past.

Another feature of this invention is that with the construction shown, or even with a standard die slide, the press can be used either for indirect extrusion or direct extrusion. To change from one type of extrusion to the other requires only a few moments because, as soon as the hollow stem has been moved out to the side of the press and disconnected from slide 52, another carrier 60 supporting a direct-extrusion die 61 can be connected to the slide and pulled back into the gate lock housing recess into operative position in front of the tubular block 6, as shown in FIG. 7. By moving carrier 60 forward on table 53, it will push carrier 20 forward away from the slide and simultaneously connect itself to the slide. Carrier 60 also supports one or more bolsters 62 in front of the extrusion die. Unlike bolster 23, the front bolster 62 does not need to be connected with block 6 because, with direct extrusion, the gate lock is not unlocked to permit the block to be moved forward. Also, with direct extrusion, the same or a different billet container can be used, but the container is not moved backward away from the gate lock housing for loading. Loading is accomplished by lifting or otherwise moving a heated billet 63 by any suitable means 64 into loading position behind the container. Then, an extrusion stem (not shown) replacing the closing disc and the stub stem 65 behind it is moved forward by ram 38 to push the billet into the stationary container and forward through it to extrude it through the die. Likewise, it is not necessary to retract the container if it is desired to change or service direct-extrusion dies. The carrier is simply moved out to the side of the housing by means of slide 52, disconnected from the slide and replaced by another like carrier supporting a new die, which is then pulled back into operative position between block 6 and the container.

An extrusion press such as disclosed herein can do both direct extruding and indirect extruding with minimum change-over for either extrusion process. The die for either type of extruding can be shifted laterally to one side of the press for servicing or replacement, with the result that the overall length of the press can be less than heretofore and with greatly improved tool-changing procedure and tool-changing time. Since stem 26 can move forward after extrusion, rod 39*a* can push the die and hollow stem forward out of the container even though the die is not secured to the stem. This means that dies having only a loose connection with the stem can be used. The shear 44 is mounted at the press in a position where it can serve both direct and indirect extruding, and shearing of the extrusion itself occurs inside the press and not in front of it. The construction of this press also permits water quenching to extend through platen 1 and close to tubular block 6, which is very desirable, and channel 12 will serve for conducting the water out of the press.

This same type of press can be used as a long stroke press with a long stem 65, in which case only one billet loader is required and it can be attached to the back of the container holder, where it will swing down out of the way as soon as a billet is pushed from the loader into the container.

According to the provisions of the patent statutues, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. In an extrusion press for both direct and indirect extrusion, a platen having a rear face and an extrusion-receiving horizontal passage extending through it from front to back, a gate lock housing mounted against said rear face and provided with a passage aligned with said platen passage, a billet container behind said housing passage and movable toward and away from it, ram means behind the container, means for moving the ram means and container toward and away from said housing, a tubular block member normally disposed in said housing passage, releasable gate lock means in said housing normally holding said block member in place, an indirect-extrusion bolster located behind said block member and having a passage therethrough aligned with the passage through the block member, an indirect-extrusion stem secured to the bolster and extending rearwardly from said housing toward said container, an extrusion die carried by the rear end of said stem, means secured to said block member for pulling it forward in said platen passage after release of said gate lock means, means connecting said bolster to said block member for forward movement therewith to draw said stem into an extrusion shearing position, said connecting means being formed to permit lateral movement of the bolster away from the block member when in their rear position, a direct-extrusion bolster, a direct-extrusion die mounted behind said direct-extrusion bolster and movable therewith, carrier means supporting said bolsters and slidable horizontally, the carrier means being provided with an open end recess containing said indirect-extrusion bolster to permit said forward movement of that bolster out of said carrier means, and means for sliding the carrier means transversely of said aligned passages for moving said indirect-extrusion bolster and stem laterally away from said block member and out beyond the side of said housing when said container is in its rear position and for moving said direct-extrusion bolster laterally into the space behind said block member vacated by the indirect-extrusion bolster to locate the direct-extrusion die in operative position for direct extrusion, and said ram means including means for engaging the rear end of a billet in the container in the container's forward position to push the billet forward out of it and through said direct-extrusion die in said operative position.

2. In an extrusion press according to claim 1, said carrier means including two separate bolster-supporting carriers, each formed for detachable connection to said sliding means in the absence of the other, there being means at the side of said housing for receiving and supporting said carriers, and the disconnection of either carrier from said sliding means and the connection of the other carrier to the sliding means occurring while the carriers are on said receiving and supporting means.

* * * * *